US006764100B1

(12) United States Patent
Miro

(10) Patent No.: US 6,764,100 B1
(45) Date of Patent: Jul. 20, 2004

(54) STATIONERY ORGANIZER

(76) Inventor: Ruth Julia Miro, apt. 3C, 4240-03 Hutchinson River Pkwy. East, Bronx, NY (US) 10475

( * ) Notice: Subject to any disclaimer, the term of this patent is extended or adjusted under 35 U.S.C. 154(b) by 0 days.

(21) Appl. No.: 10/369,228

(22) Filed: Jun. 11, 2003

(51) Int. Cl.[7] ..... B42D 1/00

(52) U.S. Cl. ..... 281/21.1; 281/15.1; 281/21.1; 402/2; 402/8; 402/19; 402/70; 402/80 R; D19/26

(58) Field of Search ..... 402/2, 8, 19, 57, 402/70, 73, 80 R, 500, 502; 281/15.1, 21.1, 27.1, 27.2; 24/67.3; D19/26, 27

(56) References Cited

U.S. PATENT DOCUMENTS

| | | | | |
|---|---|---|---|---|
| 703,260 | A | | 6/1902 | Holton |
| 735,379 | A | | 8/1903 | Holton |
| 808,652 | A | | 1/1906 | Hackmann et al. |
| 836,127 | A | | 11/1906 | Morden |
| 1,071,548 | A | | 8/1913 | Bowes |
| 1,163,766 | A | | 12/1915 | Morden |
| 1,208,663 | A | * | 12/1916 | Rueckert ..... 70/459 |
| 1,354,819 | A | | 10/1920 | Fritz |
| 1,407,863 | A | | 2/1922 | Hochenauer, Jr. |
| 1,998,977 | A | | 4/1935 | Bidwell |
| 2,144,581 | A | | 1/1939 | Trussell |
| 2,200,146 | A | | 5/1940 | Block |
| 2,583,998 | A | | 1/1952 | Cook |
| 4,365,434 | A | | 12/1982 | Doyel |
| 4,500,223 | A | | 2/1985 | Downing |
| 4,597,139 | A | | 7/1986 | Lau |
| 4,674,905 | A | | 6/1987 | Masters et al. |
| 4,832,370 | A | | 5/1989 | Jones |
| 4,932,804 | A | | 6/1990 | Richards |
| 5,138,855 | A | * | 8/1992 | Faris ..... 70/457 |
| 5,423,624 | A | | 6/1995 | Richards |
| 5,503,486 | A | | 4/1996 | Zane |
| 5,660,490 | A | | 8/1997 | Warrington |
| 5,709,409 | A | | 1/1998 | Engel |
| 6,113,298 | A | | 9/2000 | Miro |

* cited by examiner

*Primary Examiner*—Monica S. Carter
(74) *Attorney, Agent, or Firm*—Michael I. Kroll

(57) ABSTRACT

A stationery organizer is provided having parallel, C-shaped members that are threaded through the aligned apertures of numerous stationery products. The C-shaped members have adjacent first ends joined by a connecting member, and have second ends that are curved upwardly, rearwardly and inwardly, then joined to define a hook. The C-shaped members are joined by a curvilinear spring member that has a first end spaced apart from the connecting member such that an aperture is formed. The hook is insertable through the aperture only by compressing the curvilinear spring member. Once inserted the hook catches the connecting member as the compression of the curvilinear spring member is lowered, although sufficient compression load remains in the curvilinear spring member to cause the hook to bear upon the connecting member to secure the closure. Only a subsequent compression of the curvilinear spring member will disengage the hook from the connecting member for release.

11 Claims, 10 Drawing Sheets

STATIONERY ORGANIZER

BACKGROUND OF THE INVENTION

1. Field of the Invention

The present invention relates generally to stationery items and, more specifically, to binding and/or retaining of stationery items having an aperture in said items. The present invention is a selectively closable ring-shaped retaining device comprised of spaced apart C-shaped members having transverse connection members on at least one distal end. The C-shaped members have a curvilinear structure acting as a spring member and connecting said spaced apart C-shaped members. The curvilinear spring member extends along the length of said C-shaped members but terminates before each distal end of said C-shaped members. The curvilinear spring member extends from a spaced apart position from each distal end of said C-shaped member, thus forming an aperture. One distal end of said C-shaped members has a hooked shape member for the insertion of said hooked shaped member through said aperture.

2. Description of the Prior Art

There are other binding device designed for retaining various types of stationery. Typical of these is U.S. Pat. No. 703,260 issued to Holton on Jun. 24, 1902.

Another patent was issued to Holton on Aug. 4, 1903 as U.S. Pat. No. 735,379. Yet another U.S. Pat. No. 808,652 was issued to Hackmann & Palmer on Jan. 2, 1906 and still yet another was issued on Nov. 20, 1906 to Morden as U.S. Pat. No. 836,127.Another was issued on Aug. 26, 1913 to Bowes as U.S. Pat. No. 1,071,548.

Another patent was issued to Morden on Dec. 14, 1915 as U.S. Pat. No. 1,163,766. Yet another U.S. Pat. No. 1,354,819 was issued to Fritz on Oct. 5, 1920. Another was issued to Hochenauer, Jr. on Feb. 28, 1922 as U.S. Pat. No. 1,407,863. Still yet another was issued on Apr. 23, 1935 to Bidwell as U.S. Pat. No. 1,998,977.

Another patent was issued to Trussell on Jan. 17, 1939 as U.S. Pat. No. 2,144,581.Yet another U.S. Pat. No. 2,200,146 was issued to Block on May 7, 1940 and still yet another was issued on Jan. 29, 1952 to Cook as U.S. Pat. No. 2,583,998.

Another patent was issued to Doyel on Dec. 28, 1982 as U.S. Pat. No. 4,365,434. Yet another U.S. Pat. No. 4,500,223 was issued to Downing et al. on Feb. 19, 1985. Another was issued to Lau on Jul. 1, 1986 as U.S. Pat. No. 4,597,139 and still yet another was issued on Jun. 23, 1987 to Masters et al. as U.S. Pat. No. 4,674,905. Yet another U.S. Pat. No. 4,832,370 was issued to Jones on May 23, 1989 and still yet another was issued on Jun. 12, 1990 to Richards as U.S. Pat. No. 4,932,804.

Another patent was issued to Richards on Jun. 13, 1995 as U.S. Pat. No. 5,424,624. Yet another U.S. Pat. No. 5,503,486 was issued to Zane on Apr. 2, 1996. Another was issued to Warrington on Aug. 26, 1997 as U.S. Pat. No. 5,660,490 and still yet another was issued on Jan. 20, 1998 to Engel as U.S. Pat. No. 5,709,409.

U.S. Pat. No. 703,260

Inventor: Abner L. Holton

Issued: Jun. 24, 1902

This invention is an improvement in paper tablets, and particularly in that class of such tablets comprising a number of loose leaves or sheets and means for holding them together, such as are commonly used by stenographers and others for note-books; and the invention consists in certain novel constructions and combinations of parts.

U.S. Pat. No. 735,379

Inventor: Abner L. Holton

Issued: Aug. 4, 1903

This invention is an improvement in the nature of temporary binders for use on notebooks especially designed for use by stenographers; and the invention consists in certain novel constructions and combinations of parts.

U.S. Pat. No. 808,652

Inventor: John C. Hackmann et al.

Issued: Jan. 2, 1906

In combination a note-book comprising a series of loose leaves and a binder consisting of a single piece of wire bent to form a straight portion and at each end to form a complete circle standing at a right angle with said straight portion whereby the leaves will swing freely upon said circular portions from end to end thereof so as to always lie flat.

U.S. Pat. No. 836,127

Inventor: Lucena M. Morden

Issued: Nov. 20, 1906

The invention relates to that class of loose-leaf files or binders in which the perforations in the loose leaves are fitted upon two or more rings which hold the leaves movably in position, so that they may be turned over upon the rings, as upon hinge, and the inscriptions may thus be made or may be inspected upon any of the leaves at pleasure. Such rings are far more compact and more neat in appearance than the various filing pins and prongs which have been used in analogous constructions and are, moreover, adapted to combine with various holding devices, because they embrace in themselves two holding members integrally connected upon one side of the ring, to which an opening section may be hinged at one end and provided at the opposite end with a locking device, the integral members with the movable section forming the complete ring, which needs no attachments whatever for holding sheets together, and the movable section of the ring being held firmly in its closed position by the elastic adjustment of the remaining part of the ring. The present invention uses such rings in their entirety by combining them with means for adjusting two or more of such rings at suitable distances apart to hold perforated sheets or leaves of paper.

U.S. Pat. No. 1,071,548

Inventor: Edward L. Bowes

Issued: Aug. 26, 1913

A fastener having a paper-receiving annulus adapted to be separated for the insertion and removal of sheets of paper, and a paper-clamping part adjacent thereto between which and the annulus papers may be placed.

A fastener having a paper-receiving annulus adapted to be separated for the insertion and removal of sheets of paper, and a paper-clamping part adjacent and parallel thereto between which and the annulus papers may be placed.

A fastener having a paper-receiving annulus adapted to be separated for the insertion and removal of sheets of paper, and an integral recurved paper-clamping part adjacent and parallel thereto between which and the annulus papers be placed.

A paper-fastener of wire having an open annulus, one end of which is recurved to form an eye adapted to receive one end of the wire, the recurved part being continued parallel to the annulus to form paper clamping means.

A paper-fastener of wire having an open annulus, one end of which is pointed and the other which is recurved to form an eye adapted to receive the pointed end, the recurved part being continued parallel to the annulus to form paper-clamping means.

A paper-fastener of wire having an open annulus, one end of which is recurved to form an eye, the recurved part being continued parallel to the annulus to form paper-clamping means and terminating in an outwards projection adapted to engage the eye.

U.S. Pat. No. 1,163,766

Inventor: Lucena M. Morden

Issued: Dec. 14, 1915

This invention has to do with loose leaf devices, the object of the inventin being to provide an improved structure of this kind extremely simple and inexpensiv, the g31ist of this present improvement residing in the provision of a flexible bind loop or ring whereby in addition to its inexpensive character the binding edges of the covers and the leaves or of the structure with which it may be opened up flat.

U.S. Pat. No. 1,354,819

Inventor: Edith Fritz

Issued: Oct. 5, 1920

A paper filing device composed of a strip of heavy wire having one end enlarged and provided with a longitudinally extending socket of a size to receive the other end, said socket having a annular groove in one side wall at its inner end, the end for insertion in the socket having a nib at its terminal, said nib springing into said groove when the end carrying it reaches the limit of its inward movement, whereby said ends are held connected.

U.S. Pat. No. 1,407,863

Inventor: John Hochenauer, Jr.

Issued: Feb. 28, 1922

This invention relates to an improved ring design for use by school children in connection with temporary book covers and binders.

The herein described article of manufacture, consisting of a hollow open ring, composed of a sheet metal stock folded to form an elastic tube having a narrow lengthwise slit and bent to ring shape, a ball of substantially the same diameter as the tube fastened to end thereof and slightly projecting into the other end of the elastic tube may be held in alignment but may be easily pushed laterally out of alignment.

U.S. Pat. No. 1,998,997

Inventor: Paul W. Bidwell

Issued: Apr. 23, 1934

This invention relates to improvements in notebooks and the like and is directed more particularly to improvements in books having novel binding means.

A unitary binding device for the leaves of books which are perforated with rows of spaced holes adjacent their edges comprising in combination, a substantially straight elongated, rod-like tie member of wire and a plurality of separate relatively shorter rod-like ring-forming members of substantially equal length formed from bendable wire and having non-joined opposite ends, said ring-forming members being rigidly fixed to said tie member transversely thereof at spaced intervals therealong and each having a free end portion extending away from its jointure with the tie member which is arranged for inserting in the perforations of said leaves and adapted for bending to bring their said opposite ends into close adjacency to form substantially closed rings with the adjacent ends of each ring in substantial alignment with the adjacent ends of the other rings on a line substantially parallel with said tie member.

U.S. Pat. No. 2,144,581

Inventor: Clarence D. Trussell

Issued: Apr. 11, 1936

A ringed binders and particularly ringed binders of the type in which the leaves and if present, the covers may be completely reversed through an arc of substantially 180 degrees. For such results, it is desirable that the binder rings be substantially circular, at least throughout that portion transversed by the leaves or the covers in such movements.

U.S. Pat. No. 2,200,146

Inventor: Clara Block

Issued: Sep. 6, 1939

In a book comprising, a cover, a plurality of rings spatially carried by said cover, sheets of paper swingably sustained by said rings and including registering and reentrant gaps along the inner margins thereof for receiving a writing implement, a one piece substantially cylindrical resilient wire form loosely carried by and disposed substantially medially of said cover and having a plurality of spaced rings and bridge means interconnecting said rings to provide spaced relatively narrow loops and a relatively wider loop movably straddled by said narrow loops, said loops movably projecting into said gaps and widthwise thereof, and said writing implement adapted to be slidably inserted into said form to diverge said loops whereby the latter frictionally but disengageably retain said implement within said gaps and against transverse displacement relative to said sheets, said gaps having front and rear ends and said sheets having means at said ends and cooperating with said implement to prevent longitudinal displacement of the latter relative to said sheets.

U.S. Pat. No. 2,583,998

Inventor: Carl B. Cook

Issued: Oct. 28, 1949

This invention relates to improvements in books of the loose-leaf type and the principal object of the invention is to provide a binder structure which will be more flexible, durable and generally more efficient than the corresponding bindings of the prior art.

A book comprising a cover member, a filler unit having a plurality of leaf elements and a binder having interlocking engagement individually with an edge portion of each leaf element and uniting said elements, said leaves having openings in the said edge portins thereof intersected by said binder, and fillerretaining rings on said cover member embracing the said binder where it intersects the said openings whereby displacement of the filler unit from the cover member in direction radially of the rings is prevented solely by the interengagement of the rings with the binder.

U.S. Pat. No. 4,365,434

Inventor: John S. Doyel

Issued: Dec. 28, 1982

Disclosed is a display stand with split rings supporting sheet material such as photographs, recipes, instructions, addresses, etc. The stand is made entirely of integrally molded plastic components snap-locked to each other through hand assembly. The rings are deformed by hand to load them with sheet material; when released the ring end are supported by the rest of the stand so that the weight of the sheet material threaded on the ring does not deform them.

U.S. Pat. No. 4,500,223

Inventor: Gerald T. Downing et al.

Issued: Feb. 19, 1985

A carrier for holding a plurality of pages including a support member and at least one ring therefrom that includes a lower retention finger of subsantially uniform thickness and a flexible upper finger of decreasing thickness. The fingers have free ends adjacent to each other and a flexible tang at the free end of the flexible upper finger is positioned along one or more rigid tangs at the lower retention finger.

U.S. Pat. No. 4,597,139

Inventor: Po C. Lau

Issued: Jul. 1, 1986

The paper clips of the present invention are more gradually curved to have a substantial lateral extent, so that they will hold a much thicker stack of papers without deformation or buckling, as compared with the standard narrow sharply curved paper clips. More specifically, when a predetermined length of wire is employed, the clips have a ratio of the predetermined length to the width, and to the height of the clip, of between about 4 and 6. In addition, where one end of the wire is arranged to engage a stack of papers on one side and the other end of the wire is arranged to engage the stack of papers on the other side, at a point between the two ends there is a gradually curved portion corresponding generally to one-half the circumference of a circle having a diameter in the order of the transverse dimension of the clip. In one embodiment the clip has an overall generally heart-shaped configuration; and in another embodiment one end of the clip is straight and the other is formed into a relatively tight loop.

U.S. Pat. No. 4,674,905

Inventor: George S. Masters et al.

Issued: Jun. 23, 1987

A pre-assembled post lock assembly for loose leaf binders having separable covers which greatly simplifies mounting of the lock to the binder. A plastic covers press-fitted within the barrel assembly of the lock holds a spring biased ball carrid member in alignment with the barrel housing such that the locking balls are disposed for coaction with the cam surface of the barrel whether or not the lock assembly is mounted on the binder.

U.S. Pat. No. 4,832,370

Inventor: Leonard W. N. Jones

Issued: May 23, 1989

A binding element for perforated sheets of the type comprising a length of wire bent so as to form curved prongs on which the sheets may be impaled, the wire being in the shape of a flat comb, the prongs of which are closed at their tips and opened at their bases or roots which are connected to their neighbors by aligned lengths of wire forming the stock or the spine of the comb, the strip being designed to be converted to a slotted tube by suitable bending of the prongs. In accordance with the invention the concave surface with part of each prong which is midway between its tip and root is formed with an indentation, which indentation assists the closing of the binding element very effectively and without any visible sign.

U.S. Pat. No. 4,932,804

Inventor: Donna E. Richards

Issued: Jun. 12, 1990

A pair fo flexible retainer strips each of which can be held in ring configuration by a head and socket at opposite ends of the strip which interlock to retain a stack of perforated sheets in a file folder. Each retainer strip is slidably mounted in separate guide channel formed in an anchor element securable to the cover of a file folder. The ends of the strip can be readily uncoupled to enable the insertion in or removal of a sheet at any location in the stack widhot having to remove any of the remaining sheets of the stack from the retainer strip.

U.S. Pat. No. 5,423,624

Inventor: Donna E. Richards

Issued: Jun. 13, 1995

A system for retaining stacks of loose-leaf papers in a file folder providing random access to any one sheet is disclosed. The system includes flexible retainer strips sized to fit through perforated holes in the paper and whose ends are configured to releasably couple to form enclosure rings. The ends are securely engaged by relative twisting and inserting of one into the other. A series of adjustment apertures along the length of the retainer allows the formation of varying sizes of enclosure rings. Loops secured to the file folder receive the retainer strips thus holding the paper stack to the folder. The loops are positioned proximate an edge of the folder and pivotally mounted with a rotational axis aligned with the edge so as to rotate from one side of the folder to the other. The front or backside of any sheet in the stack may thus be displayed flat for photocopying or other purpose without removal from the retainer system. The mounting support for the loops may be attached to an existing folder with conventional bendable metal tabs, or may include such bendable tabs and be adhesively or otherwise permanently secured to a folder by the manufacturer or by the user. The mounting support may be of various materials and include separate pivoting loops in a hinge or have loops integral with the support pivoting about one or more living hinges.

U.S. Pat. No. 5,503,486

Inventor: Barry Zane

Issued: Apr. 2, 1996

The improved notebook and notebook cover assembly of the present invention includes a notebook, preferably of a loose-leaf type, and a sub-assembly which includes front and rear notebook covers, an edge binder interconnecting the two covers and foldable back upon itself, and a notebook connector releasably interconnecting the notebook only to the covers. Due to the edge binder the covers are movable between a first position wherein the front cover overlies and protects the notebook and a second position wherein the front cover is behind and flat against the rear cover, thus fully exposing the notebook and supporting it in a flat position for easy viewing and writing therein. The edge binder can have a longitudinal fold line along the length of the center line of the central portion thereof, or can be divided along that center line into two halves joined together by a hinge, such as a piano hinge or a flexible strip of plastic, cloth, paper or rubber. Openable rings or the like releasably secure the notebook to the covers, either directly thereto or to wings connected to the inner surfaces of the covers. If desired, the edge binder can be integral with the covers. Detents may be present on the covers to releasably hold them together when the front covers is in the second position.

U.S. Pat. No. 5,660,490

Inventor: Glenn Warrington

Issued: Aug. 26,1997

A ring binder having a pair longitudinally arranged leaves partially surrouned and clasped by a resilient metallic shield and a plurality of openable rings having base ends connected to leaves such that relative angular orientation of the lesves corresponds to an open or closed condition of the rings. by shaping and arranging the rings with respect to the leaves such that the closed condition of the rings corresponds to the relative angular orientation of the leaves being 180 degrees or less measured on a side of the leaves opposite the ring, results in the rings always being urged to the open condition whether open or closed. At least one of the rings provides a hook formation to lock rings halves of at least one ring to lock the rings and leaves in the closed orientation.

U.S. Pat. No. 5,709,409

Inventor: Peter H. Engel

Issued: Jan. 20, 1998

This disclosure is directed to a spiral bound book having a permanent magnet incorporated in one of the covers and a complementary weight or magnet incorporated in the opposite cover. The arrangement is such that the spiral bound book is rendered readily displayable or used by magnetic attraction to a magnetically attractive surface whereby the weight or magnet in the opposite cover will cause the book to be displayed in an open position. The individual pages may also incorporate a permanent magnet whereby the respective pages can be maintained or disposed in any selectable open position.

There are numerous binding devices that provide permanent or temporary restraint for stationery items. While these retainers may be suitable for the purposes for which they where designed, they where designed, they would not be suitable for the purposes of the present invention as heretofore described. It is thus desirable to provide a rin-shaped retaining device having a simple closure means comprised of a hook-shaped member at one distal end that can be inserted into an aperture at the other distal end.

SUMMARY OF THE PRESENT INVENTION

The present invention relates generally to stationery items and, more specifically, to binding and/or retaining of stationery items that will allow for the temporary and/or permanent restraint and organization of such items.

A primary object of the present invention is to provide a ring-shaped retaining device that will overcome the shortcomings of prior art devices.

Another object of the present invention is to provide a ring-shaped retaining device that can selectively hold a plurality of items having at least one aperture.

Yet another object of the present invention is to provide a ring-shaped retaining device for selectively maintaining the organization of a plurality of items, such as sheets of paper having at least one aperture therein.

Still yet another object of the present invention is to provide a ring-shaped retaining device that can be selectively opened and closed.

Another object of the present invention is to provide a ring-shaped retaining device that can be selectively opened or closed having no moving parts.

Yet another object of the present invention is to provide a ring-shaped retaining device having a hook-shaped member on one distal end and an aperture for the insertion of the hook-shaped member on the other distal end.

Still yet another object of the present invention is to provide a ring-shaped retaining device being compressible whereby the distal ends can be moved from an engaging to disengaging position without permanently deforming said ring-shaped device.

Additional objects of the present invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

FIG. 1 is a perspective view, of the invention. The ring-shaped device is shown selectively retaining a plurality of margin-punched papers. Shown also is the easy accessibility to a plurality of papers being retained by said ring-shaped retaining device due to the lack of hindrance on the movement of the plurality of paper by said device.

FIG. 2 is a perspective view of the present invention showing the ring-shaped retaining device in the opened position. In this position one or more items having at least one aperture can be inserted onto said ring-shaped retaining device and organizationally maintained thereon by closure of said device. Shown also is the hook-shaped member. The hook-shaped member provides the locking fimction of said ring-shaped retaining device and is located at one of the distal ends of the device. Shown also is the insertion aperture which is located at the alternate distal end of the device. It provides the retaining function of the device only when being used in conjunction with the hook-shaped member of the device.

FIG. 3 is a perspective view of the device. Shown is the ring-shaped device in the closed position having a plurality of bound stationary items. Shown also is the device's ability to be adapted to singular or plural items of different or the same nature.

FIG. 4 is a perspective view of the ring-shaped retaining device. Shown is a view of the C-shaped member and the path it takes as it transgresses into the device's aperture. Shown also is the exterior surface of said ring-shaped retaining device and its lack of any hard corners or sharp edges. This is to insure safe and easy manipulation of a plurality of stationery items onto the device.

Figure 5:
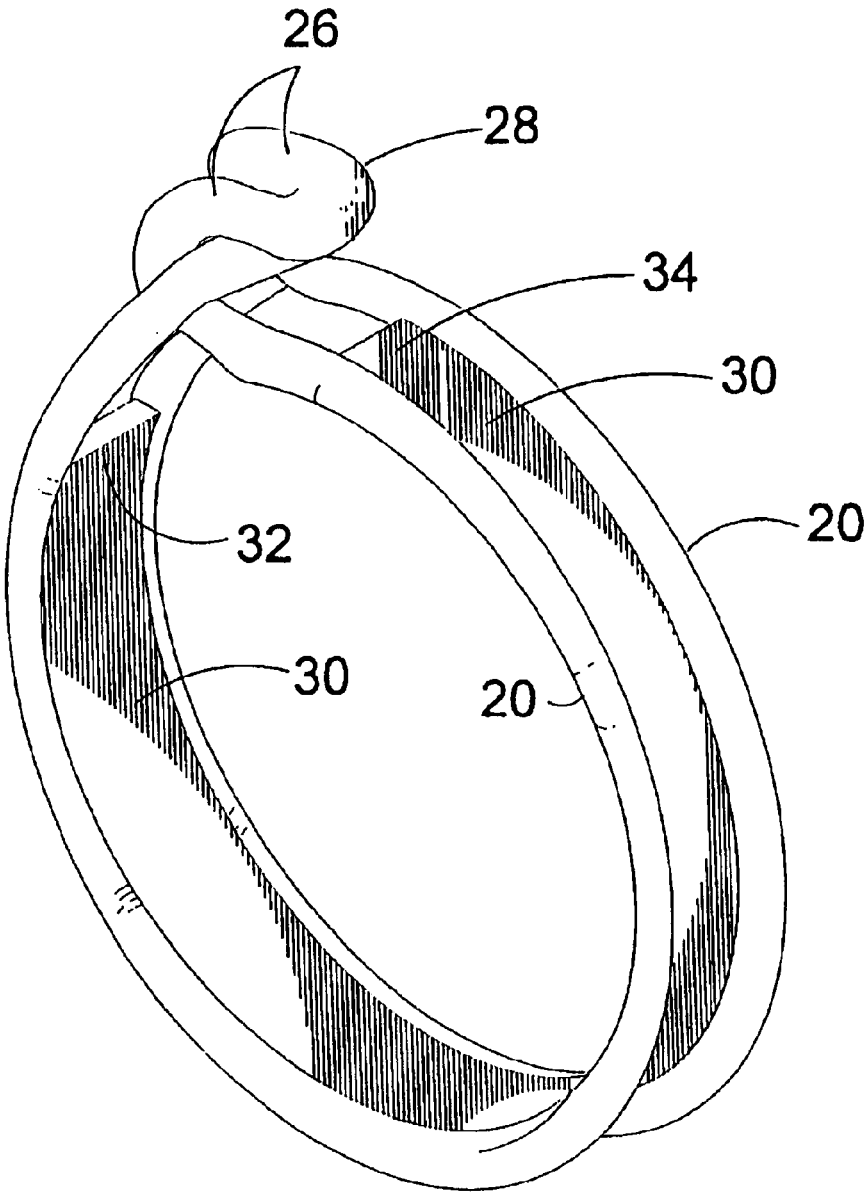
FIG. 5 is a perspective view of the device in the closed position.
Figure 6:
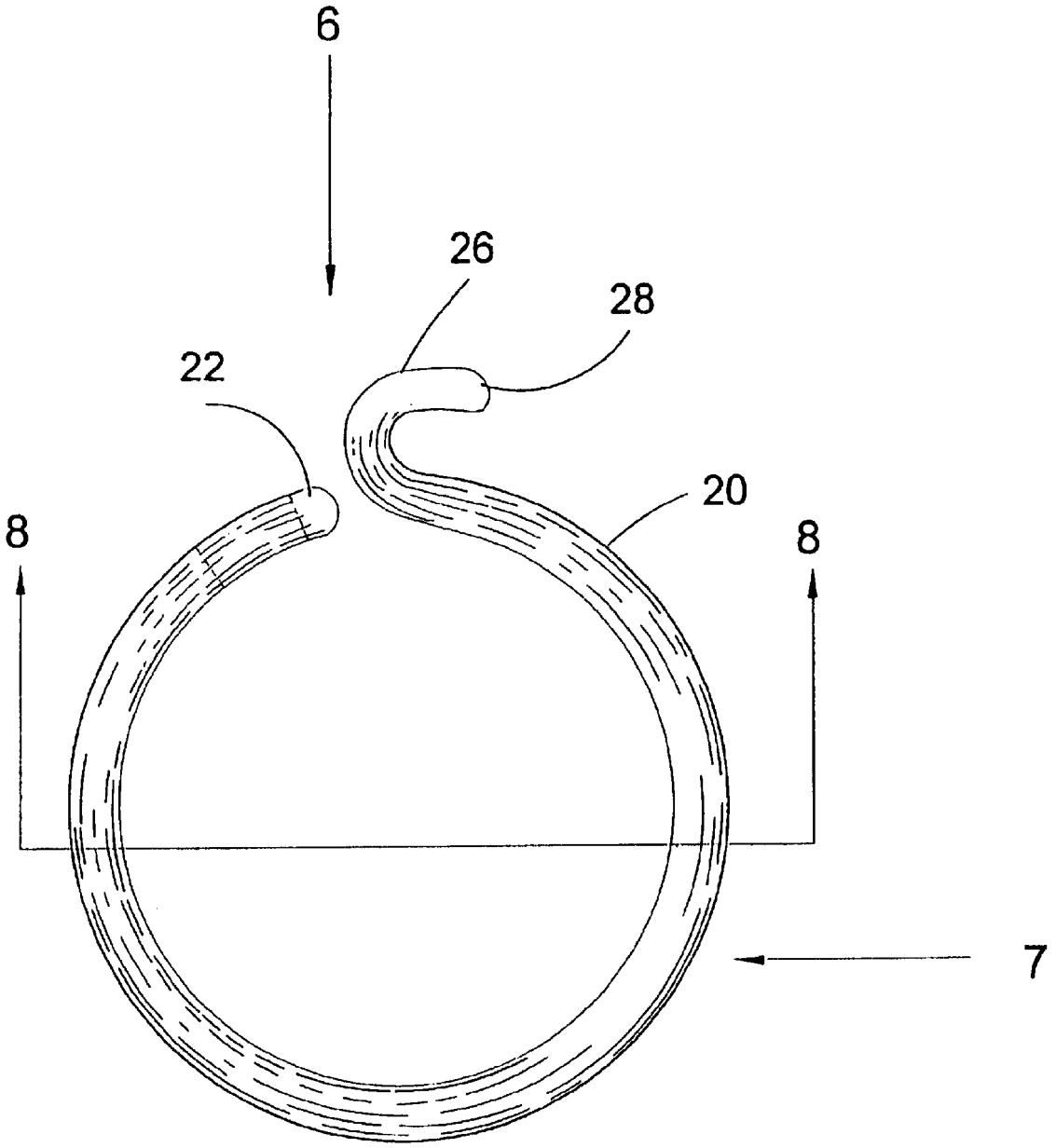
FIG. 6 is a full side view of the device and provides call outs for additional drawings in order to cover all expected views of the device.
Figure 9:
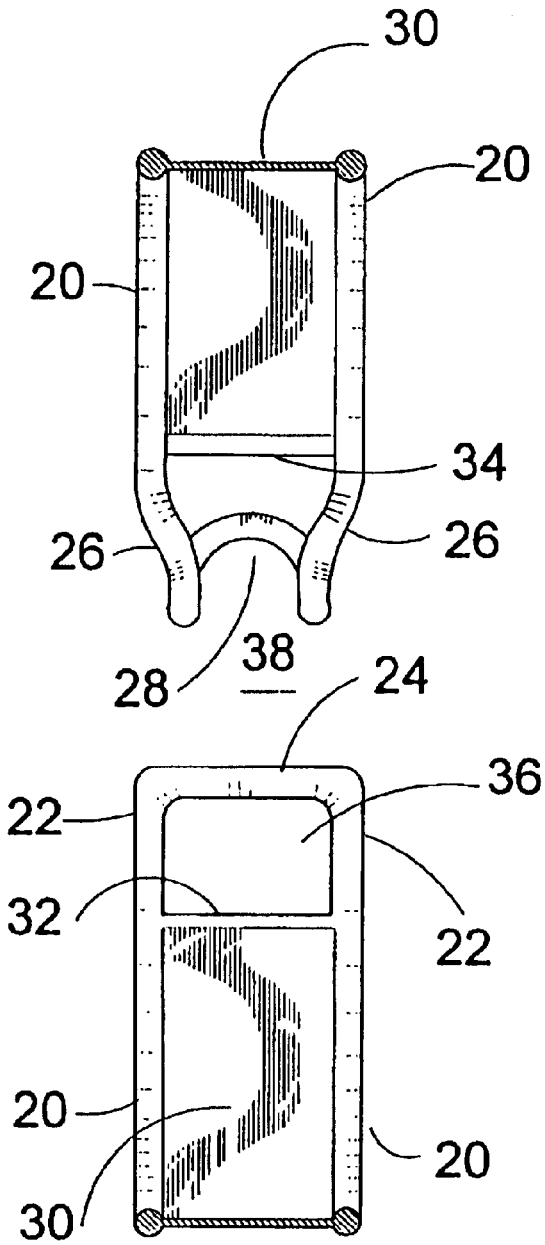

FIG. 9 is a cross sectional view, taken from FIG. 5, showing two functional parts of the ring-shaped retaining device. It also shows a relation to the approximate gauge of the curvilinear spring member. Shown also are the hook-shaped member and the insertion aperture.

Figure 10:
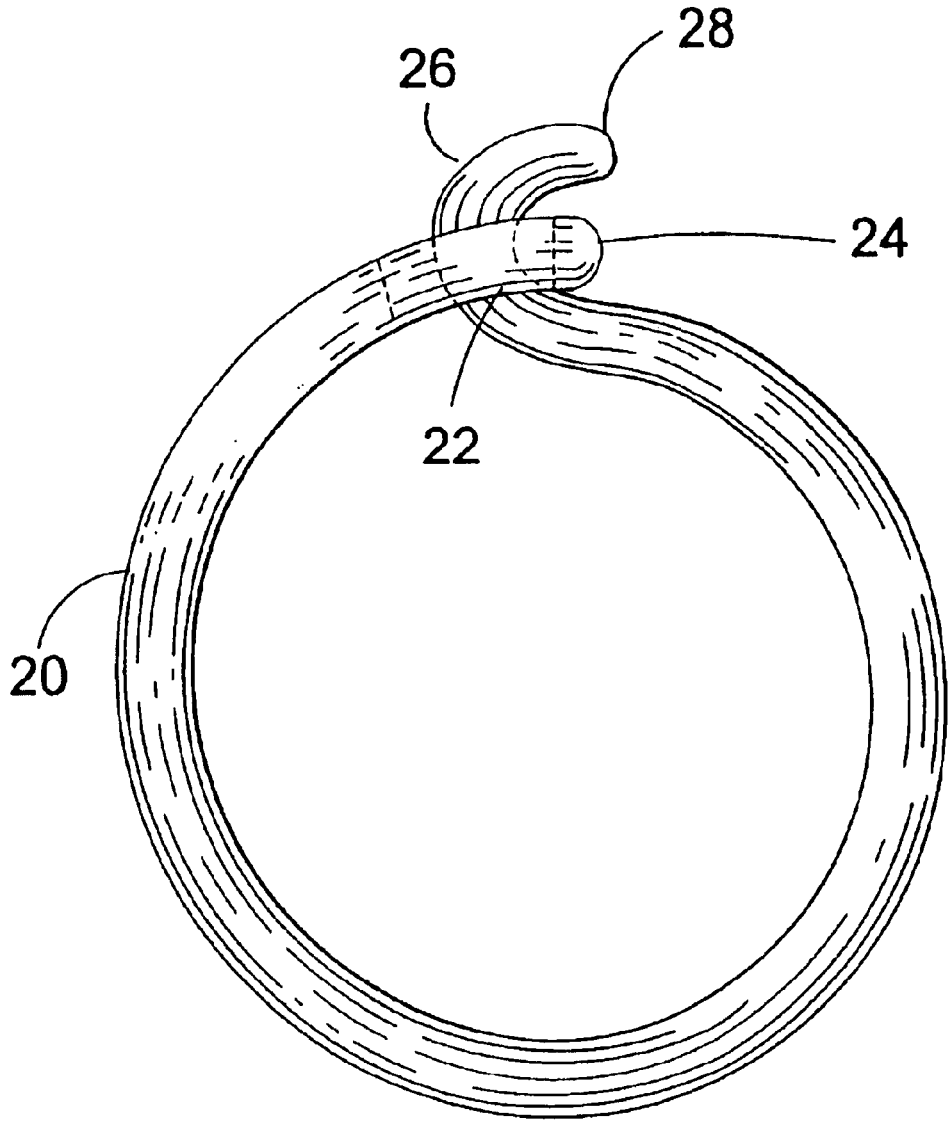

FIG. 10 is a side view of the ring-shaped retaining device. This drawing provides a full side view of the device in its closed position. Shown also is the lack of structural deformation of the C-shaped members as the distal ends are forced together.

DESCPRIPTION OF THE REFERENCED NUMERALS

Turninng now descriptively to the drawings, in which similar reference characters denote similar elements throughout the several views, the figures illustrate the Stationery Organizer of the present invention. With regard to the reference numerals used, the following numbering is used throughout the various drawing figures.

10 the Stationery Organizer of the present invention

12 stationery products

14 stationery products aligned apertures

20 C-shaped member

22 C-shaped member first end

24 C-shaped member first end connecting member

26 C-shaped member second end

28 U-shaped hook

30 curvilinear spring member

32 curvilinear spring member first end

34 curvilinear spring member second end

36 aperture

38 opening

DETAILED DESCRIPTION OF THE PREFERRED EMBODIMENT

Turning now descriptively to the drawings, in which similar reference characters denote similar elements throughout the several views, FIGS. 1–10 illustrate the Stationery Organizer of the present invention indicated generally by the numeral 10.

Figure 1:
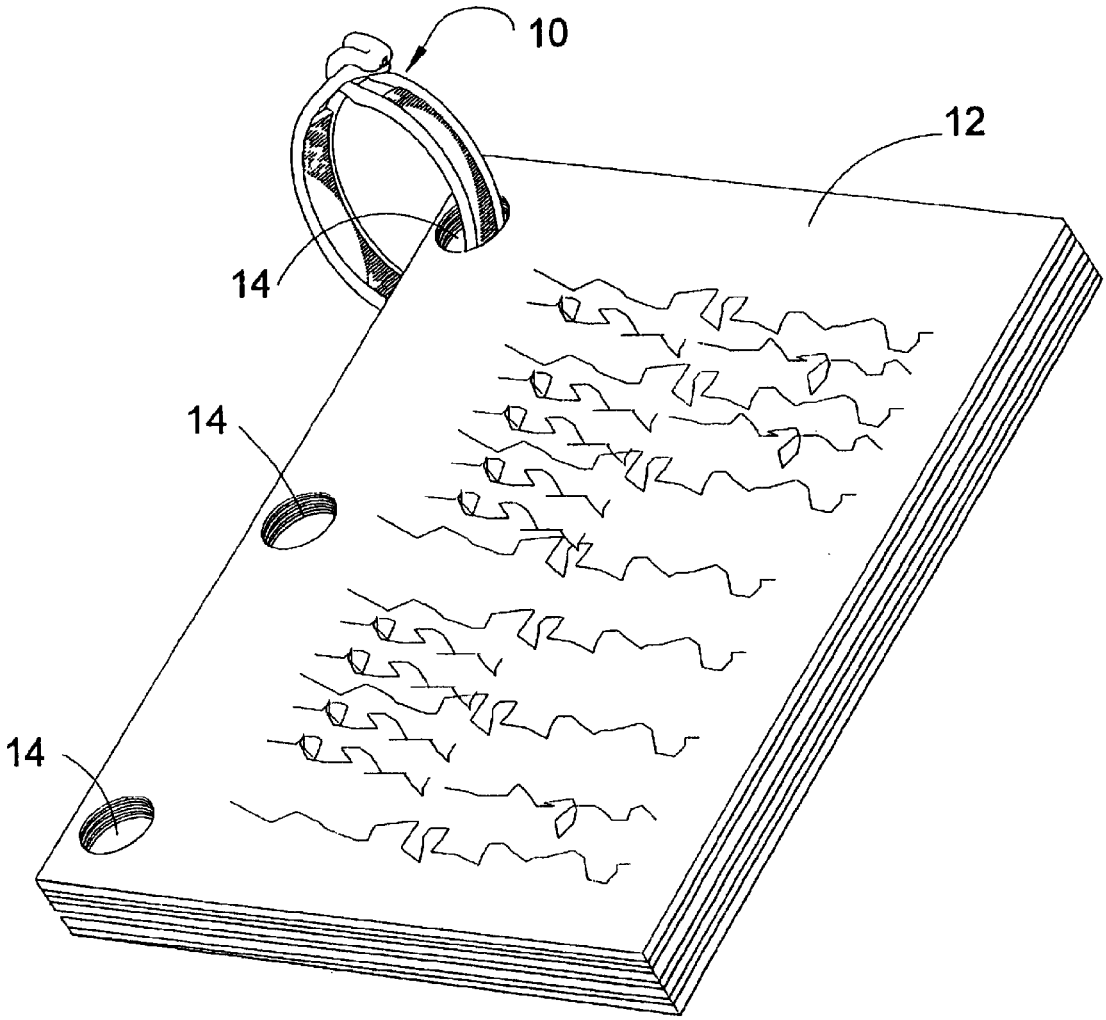
Figure 2:
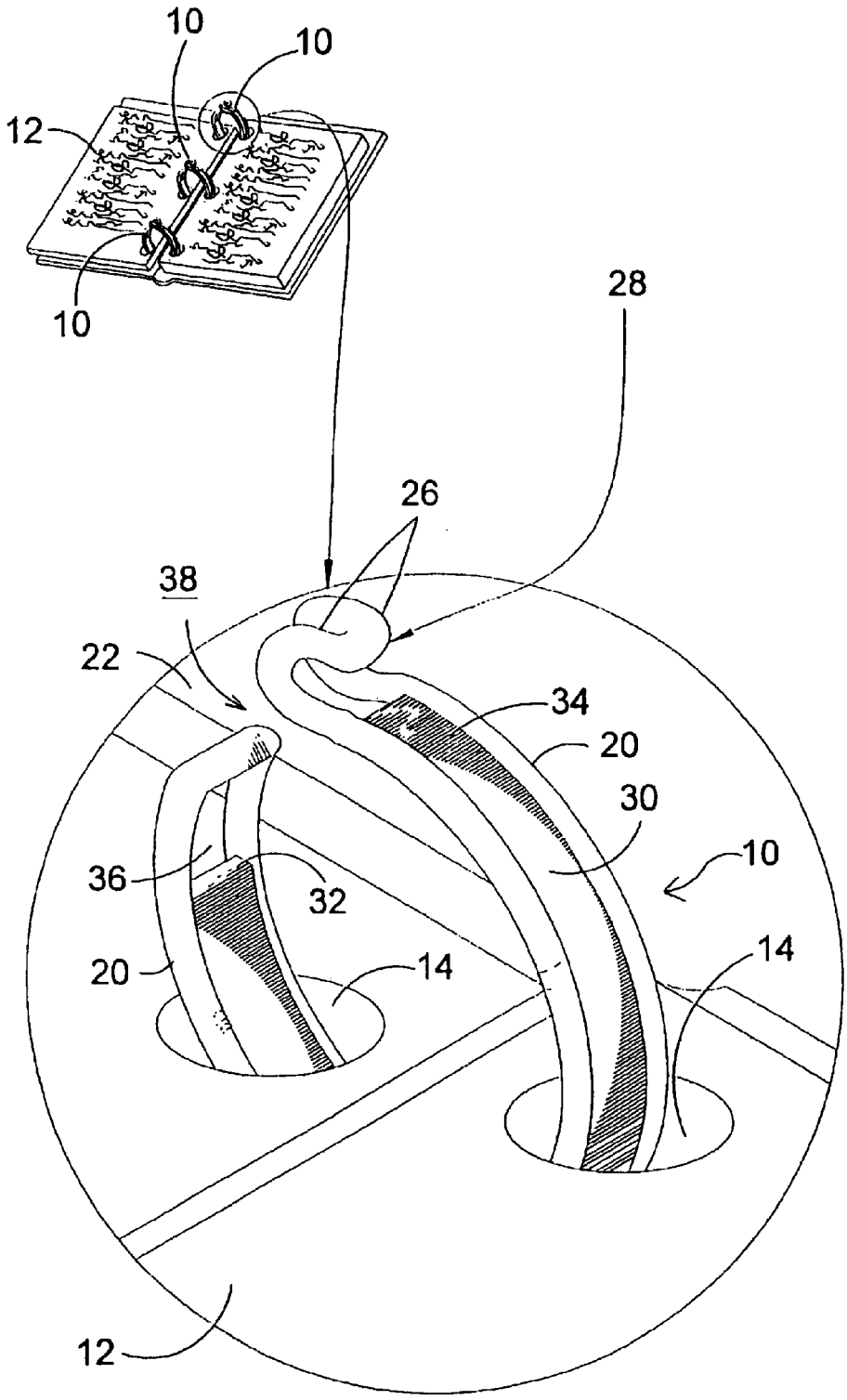
Figure 3:
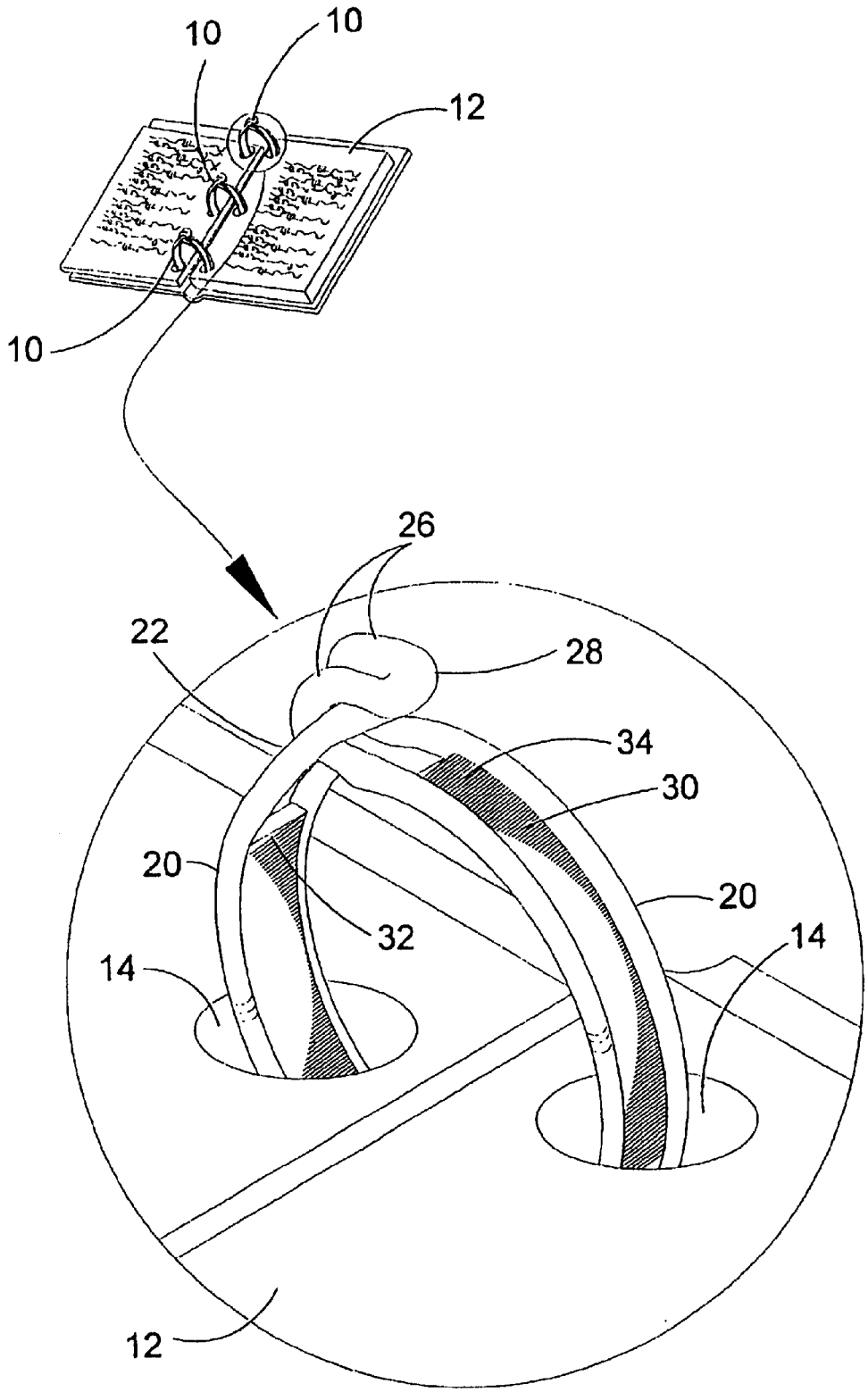

The device 10 is shown in FIG. 1 in use with respect to a stack of stationery products 12 that has several aligned apertures 14. FIG. 2 and FIG. 3 depict an application wherein a separate device 10 is provided for each of three of the stationery product apertures 14, the devices 10 being open in FIG. 2 and closed in FIG. 3.

As fuirther shown in FIGS. 4–10, the ring-shaped device 10, is formed from two generally C-shaped members 20 having first ends 22 that are joined by a transversely positioned connecting member 24, preferably of the same material. The connecting member 24 can also be a re-directed continuation of the C-shaped members' first ends 22. The C-shaped members 20 have second ends 26, which, in the preferred embodiment 10, are curved upwardly, rearwardly and inwardly, then joined to define a generally U-shaped hook 28.

The C-shaped rings 20 are joined along a substantial portion of their lengths by a resilient curvilinear spring member 30, having a first end 32 and a second end 34. The spring member first end 32 and second end 34 generally correspond with the C-shaped member first ends 22 and second ends 26, however, the curvilinear spring member first end 32 is spaced apart from the connecting member 24. As a result, the connecting member 24, C-shaped members-20 and curvilinear spring member first end 32 define an aperture 36. In the preferred embodiment, the curvilinear spring member 30 is chosen such that the C-shaped members 20 are substantially parallel.

Figure 4:
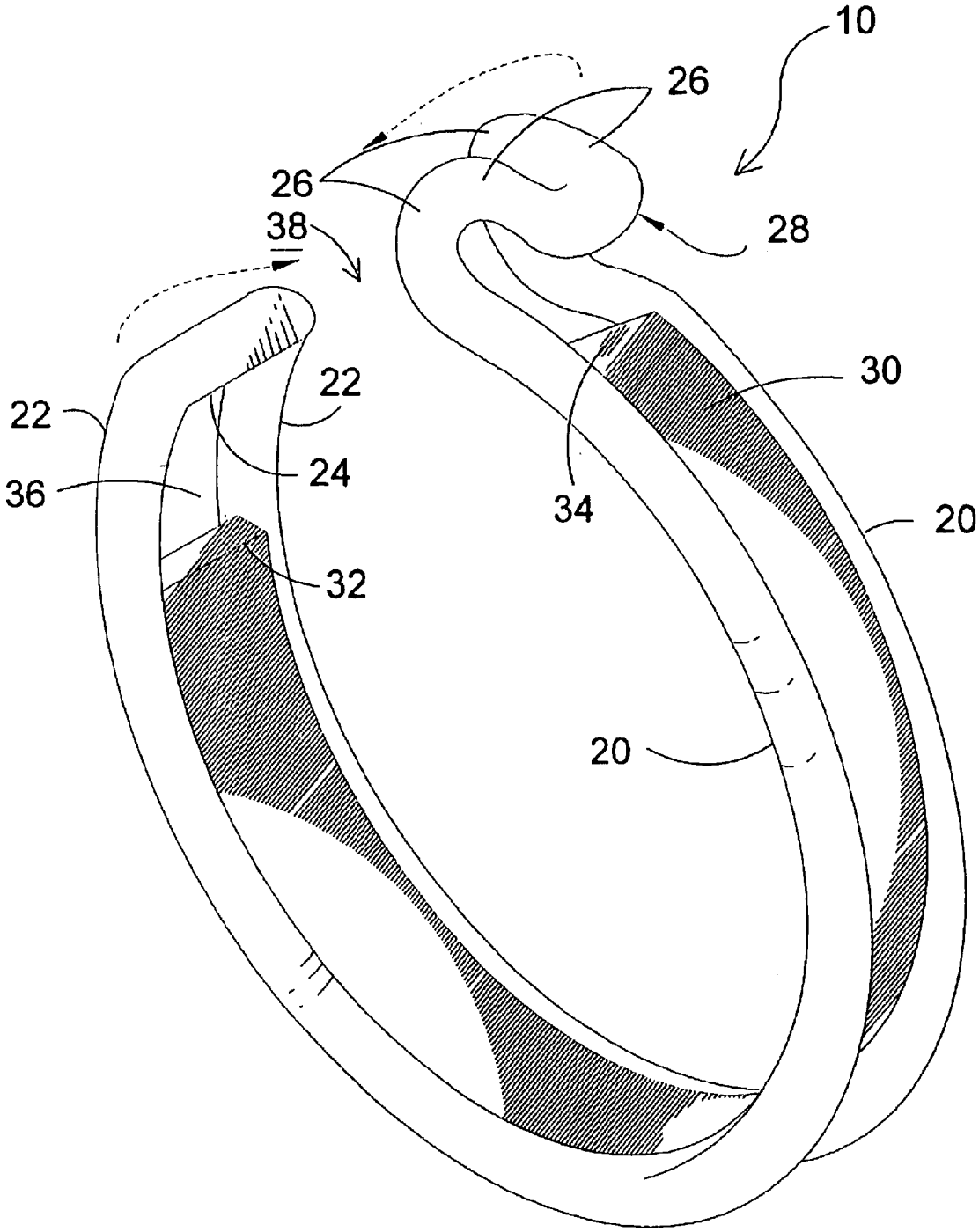

Either the hook 28 or the C-shaped member first ends 22 can readily be inserted into a number of generally planar stationery products 12 having at least one aperture 16. This is done without substantial resistance from the curvilinear spring member 30 in that the unloaded curvilinear spring member 28 results in an opening 38 between the hook 28 and the C-shaped member first ends 22, as shown in FIG. 4. Very little deformation of the curvilinear spring member 30, if any, is required to insert the stationery products 12 into the opening 38 such that the C-shaped member first ends 22, or the hook 28, can be inserted through the desired stationery product aperture 16.

Once the device 10 has been inserted through the stationery products 12, the device 10 is compressed by squeezing the C-shaped members 20. When the curvilinear spring member 30 is loaded by such compression, the hook 28 is disposed toward the aperture 36, and is inserted therein.

After the hook 28 has been inserted through aperture 36, the compression ceases and the load on the curvilinear spring member 30 begins to diminish, thus moving the hook 28 and connecting member 24 together. At the point the hook 28 contacts the connecting member 34, the curvilinear spring member 30 remains under some load, such remaining load causing the hook 28 to be biased against the connecting member 24, the connecting member 24 being hooked by the hook 24 as a result of this bias. This bias is a sufficient retention mechanism to cause the device 10 to stay closed until affirmatively compressed by later squeezing of the C-shaped members 20.

Figure 7:
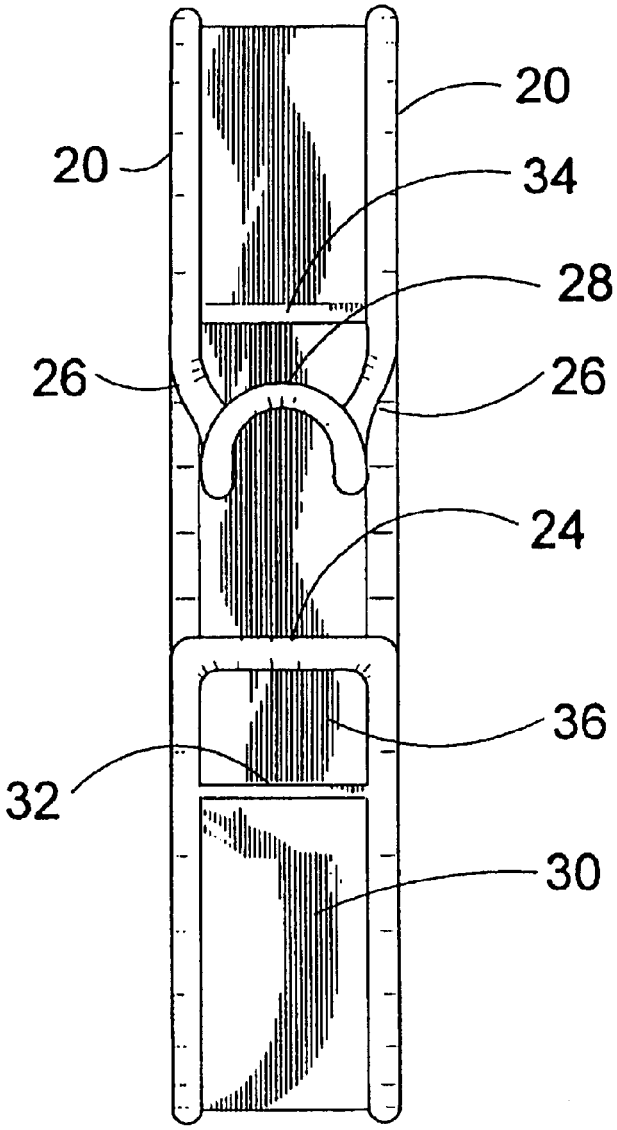
FIG. 7 is a top view taken from FIG. 5 as indicated, showing the opening between the connecting member and the hook shaped member. Also shown is the offset of the hook-shaped member and how the offset of the hookshaped member provides proper clearance of the inner parameter of the insertion aperture and to insure the ring-shaped retaining device performs its retaining function effectively.
Figure 8:
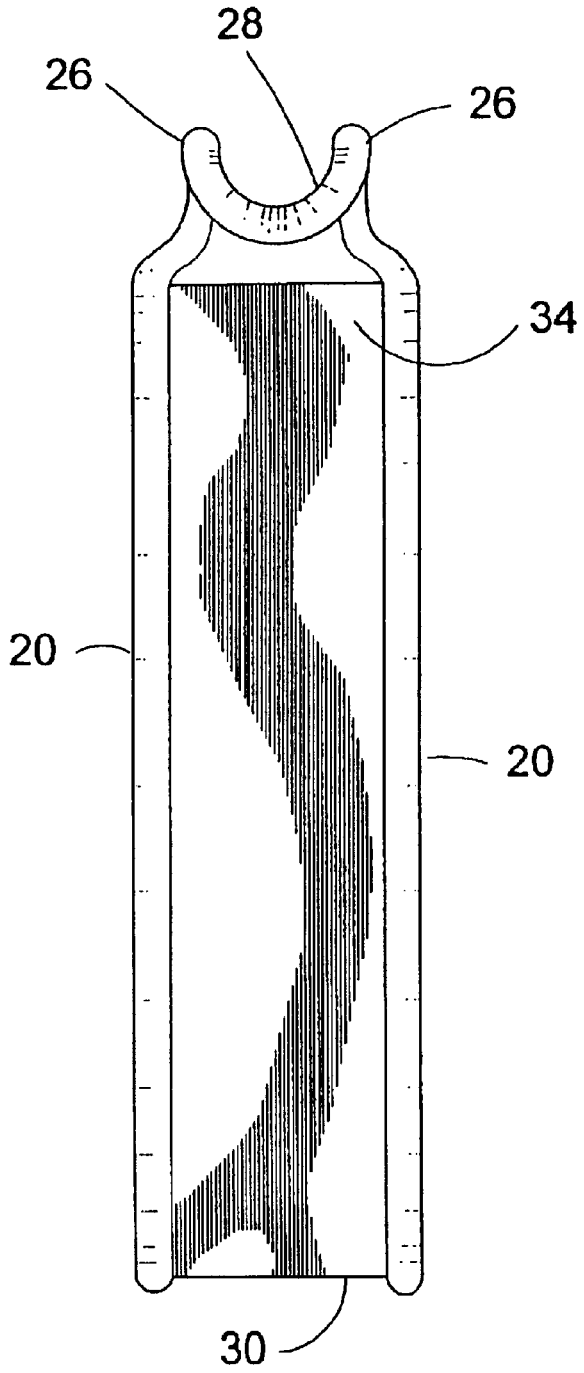
FIG. 8 is a front view taken from FIG. 5, as indicated, showing the ring-shaped retaining device. Shown is the offset curvature of the C-shaped members as they converge to form the hook-shaped member.

As shown in FIGS. 7–9, the inward component of the C-shaped member second end curved portion results in the hook 28 being of such a width that the hook 28 moves easily between the two C-shaped members 20 as the hook 28 is inserted into the aperture 36. FIG. 10 depicts the closure of the device 10 with the hook 28 inserted through the aperture 36 in a mutually biased condition with the connecting member 24.

To retrieve one or more of the stationary products 12, the C-shaped members 20 are again squeezed, causing the hook 28 to separate from the connecting member 24. This allows the removal of the hook 28 from the aperture 36, followed by the full relaxation of the loaded curvilinear spring member 30, such that the opening 38 is again available. The retained stationery products 12 can then be removed or others added.

In another embodiment, the C-shaped member first ends 22 are redirected and joined to form an aperture corresponding in ftmction to aperture 36, negating the need for connecting member 24.

In another embodiment, the C-shaped member second ends 26 are not joined, but are still curved to present individual U-shaped hooks. These are substantially parallel and act as a double hook when inserted into the aperture 36. An additional member can also be chosen to join such parallel hooks.

The materials used for the C-shaped members 20, the connecting member 24, and the curvilinear spring member 30, can be chosen from a wide variety of plastics and metals, all in accordance with the present invention, and as determined by the intended end use for the overall device, as will occur to those of skill in the art upon review of the present disclosure. Depending on the material chosen for the C-shaped members 20, such members 20 may contribute to the spring force of the curvilinear spring member 30.

It will be understood that each of the elements described above, or two or more together may also find a useful application in other applications differing from that described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for organizing products having at least one aligned aperture, comprising:

(a) a pair of generally C-shaped members, each having a first end and a second end, the second ends being curved and joined to define a hook;

(b) a first end connecting member, attached to the first end of each C-shaped member; and (c) an elongated spring member, the spring member attached to, and between, the C-shaped members, the spring member having a first end, the spring member first end being spaced apart from the first end connecting member, such that the C-shaped members' joined second ends are insertable between the first end connecting member and the spring member first end when the C-shaped members are compressed, and further such that the C-shaped members' joined second ends hook the first end connecting member when such compression ceases, the spring member being loaded during compression of the C-shaped members, the spring member biasing the C-shaped members' second ends against the first end connecting member following such insertion and compression cessation.

2. The device of claim 1, wherein the C-shaped members are substantially parallel.

3. A device for organizing products having at least one aligned aperture, comprising:

(a) a pair of generally C-shaped members, each having a first end and a second end, each of the second ends being curved to define a hook;

(b) a first end connecting member, attached to the first end of each C-shaped member; and (c) an elongated spring member, the spring member attached to, and between, the C-shaped members, the spring member having a first end, the spring member first end being spaced apart from the first end connecting member, such that the C-shaped members' second ends are insertable between the first end connecting member and the spring member first end when the C-shaped members are compressed, and further such that the C-shaped members' second ends hook the first end connecting member when such compression ceases, the spring member being loaded during compression of the C-shaped members, the spring member biasing the C-shaped members' second ends against the first end connecting member following such insertion and compression cessation.

4. The device of claim 3, further comprising a second end connecting member, the second end connecting member joining the C-shaped members' second ends.

5. The device of claim 3, wherein the C-shaped members are substantially parallel.

6. A device for organizing products having at least one aligned aperture, comprising:

(a) means for simultaneously compressing two aligned and substantially parallel C-shaped members, such that the ends of the C-shaped members are brought closer by such compression, and moved farther apart when such compression ceases; and (b) means for closing the C-shaped members until the C-shaped members are again compressed.

7. A device for organizing products having at least one aligned aperture, comprising:

(a) a pair of generally C-shaped members, each having a first end and a second end, the first ends being guided through and joined, the second ends being curved and joined to define a hook; and (b) an elongated spring member, the spring member attached to, and between, the C-shaped members, the spring member having a first end, the spring member first end being spaced apart from the C-shaped members' joined first ends, such that the C-shaped members' joined second ends are insertable between such joined first ends and the spring member first end when the C-shaped members are compressed, and further such that the C-shaped members' joined second ends hook the C-shaped members' joined first ends when scuh compression ceases, the spring member being loaded during compression of the C-shaped members, the spring member biasing the C-shaped members' second ends against the C-shaped members' joined first ends following such insertion and compression cessation.

8. The device of claim 7, wherein the C-shaped members are substantially parallel.

9. A device for organizing products having at least one aligned aperture, comprising:

(a) a pair of generally C-shaped members, each having a first end and a second end, the first ends being guided though and joined, each of the second ends being curved to define a hook; and (b) an elongated spring member, the spring member attached to, and between, the C-shaped members, the spring member having a first end, the spring member first end being spaced apart from the C-shaped members' joined first ends, such that the C-shaped members' second ends are insertable between such first ends and the spring member first end when the C-shaped members are compressed, and further such that the C-shaped members' second ends hook the C-shaped members' joined first ends when such compression ceases, the spring member being loaded during compression of the C-shaped members, the spring member biasing the C-shaped members' second ends against the C-shaped members' joined first ends following such insertion and compression cessation.

10. The device of claim 9, further comprising a second end connecting member, the second end connecting member joining the C-shaped members' second ends.

11. The device of claim 9, wherein the C-shaped members are substantially parallel.

* * * * *